US010260402B2

(12) United States Patent
Han et al.

(10) Patent No.: US 10,260,402 B2
(45) Date of Patent: Apr. 16, 2019

(54) NON-NEGATIVE PRESSURE RADIATOR CAP

(71) Applicants: Hyundai Motor Company, Seoul (KR); Kia Motors Corporation, Seoul (KR)

(72) Inventors: Su Dong Han, Gyeonggi-Do (KR); Hyung Kook Kim, Gyeonggi-Do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 120 days.

(21) Appl. No.: 15/055,116

(22) Filed: Feb. 26, 2016

(65) Prior Publication Data

US 2017/0167356 A1 Jun. 15, 2017

(30) Foreign Application Priority Data

Dec. 9, 2015 (KR) ..... 10-2015-0174770

(51) Int. Cl.
*F01P 11/02* (2006.01)
*B65D 51/16* (2006.01)

(52) U.S. Cl.
CPC ..... *F01P 11/0238* (2013.01); *B65D 51/1644* (2013.01)

(58) Field of Classification Search
CPC ..... F01P 11/0238; B65D 51/1644
USPC ..... 220/DIG. 32
See application file for complete search history.

(56) References Cited

U.S. PATENT DOCUMENTS 3,878,965 A * 4/1975 Crute ..... F01P 11/0238 220/295
4,185,751 A * 1/1980 Moore ..... F01P 11/0238 220/203.26
4,271,976 A * 6/1981 Detwiler ..... F01P 11/0247 220/203.07
6,276,312 B1 * 8/2001 Summan ..... F01P 11/16 123/41.54
6,360,957 B1 * 3/2002 Harris ..... F01P 11/0238 236/101 D (Continued)

FOREIGN PATENT DOCUMENTS

JP H0516960 A 1/1993
JP H06109165 4/1994

(Continued)

*Primary Examiner* — James N Smalley
(74) *Attorney, Agent, or Firm* — Mintz Levin Cohn Ferris Glovsky and Popeo, P.C.; Peter F. Corless

(57) ABSTRACT

A non-negative pressure radiator cap is provided and includes a pressure valve having a pressure member, disposed inside a body while having an aperture formed therein. The pressure member is pressed based on an increase in pressure of coolant to move coolant toward a reservoir tank. Additionally, a vacuum valve that includes a head part and a neck part moves vertically based on the pressure of the coolant to open or close the aperture. The neck part passes through the aperture from bottom to top. A sealing member is disposed between the pressure valve and the vacuum valve and has an insertion aperture that is formed at a position corresponding to the aperture of the pressure valve. A retainer is further inserted into the aperture and the insertion hole and a guide directs the vacuum valve to move vertically when the vacuum valve is opened or closed.

8 Claims, 7 Drawing Sheets

(56) References Cited

U.S. PATENT DOCUMENTS

| | | | | |
|---|---|---|---|---|
| 2002/0035874 | A1* | 3/2002 | Watanabe | ..... F01P 11/0238 73/706 |

FOREIGN PATENT DOCUMENTS

| | | | | | |
|---|---|---|---|---|---|
| JP | 2007-303363 | A | | 11/2007 | |
| JP | 2007303363 | A | * | 11/2007 | ..... F01P 11/00 |
| JP | 2012-132388 | A | | 7/2012 | |
| JP | 2014-139446 | | | 7/2014 | |
| KR | 2012-0065866 | | | 6/2012 | |
| KR | 20150070773 | | | 6/2015 | |

* cited by examiner

NON-NEGATIVE PRESSURE RADIATOR CAP

CROSS-REFERENCE TO RELATED APPLICATION

This application claims the priority benefit of Korean Patent Application No. 10-2015-0174770, filed on Dec. 9, 2015 in the Korean Intellectual Property Office, the disclosure of which is incorporated herein by reference.

BACKGROUND

1. Field of the Invention

The present invention relates to a radiator cap applied to a vehicle, and more particularly to a non-negative pressure radiator cap that prevents coolant from flowing back into a reservoir tank when a vacuum valve is opened.

2. Description of the Related Art

Radiators are devices that radiate heat or light to the atmosphere. Since a radiator preferably has a substantially large heat radiation area to increase cooling efficiency, the radiator has a structure in which tanks for storing coolant are installed to both sides of a radiator core formed by welding metal plates (fins), made of a material having a high heat transfer rate, to flat tubes. Additionally, downflow radiators, in which tanks are arranged vertically and coolant flows from top to bottom using the principle of convection, by which hot water flows upward and cold water flows downward, are mainly used. However, crossflow radiators, in which tanks are arranged horizontally and coolant flows laterally, are gradually increased.

Radiator cores are typically formed by welding copper fins to brass tubes, but aluminum radiators, in which both of tubes for passing coolant therethrough and fins coming into contact with air are made of aluminum, which has a reduced specific gravity, are currently being used. Tanks made of resin such as nylon, rather than brass or aluminum, and filled with glass fiber are also being used with the goal of reducing the weight thereof.

Further, a radiator is equipped with a radiator cap for replenishing coolant. A conventional radiator cap is a cap through which coolant communicates with outside air and a pressurized type radiator cap which seals the inside of a radiator is currently used in the related art. In particular, since water boils at 100° C. under atmospheric pressure, and thus, the pressure and boiling point of water are increased in the sealed state, as a result of which the difference between the temperature of water and the temperature of outside air is increased. Therefore, the cooling effect may be increased.

The pressurized type radiator cap is equipped with a pressure valve and a vacuum valve. The pressure valve is opened when the boiling point of coolant increases to a temperature of about 110 to 120° C. and the internal pressure of the radiator increases to a pressure of about 0.9 to 1.0 $kgf/cm^2$, and thus extra coolant is discharged from the radiator. In contrast, the vacuum valve is opened when the temperature of coolant is decreased and the internal pressure of the radiator is a negative pressure, and thus coolant is supplied to the radiator causing the radiator to be filled with coolant.

FIG. 1 is a diagram illustrating a cooling system of a typical fuel cell vehicle according to the related art. A radiator cap CAP in FIG. 1 is disposed at the upper side of a radiator, and coolant is circulated by a water pump PMP. FIG. 2 is a view illustrating a conventional radiator cap CAP, and FIG. 3 is a graph illustrating the operation of FIG. 2 according to the related art. When a vacuum valve 30 is opened or closed, the radiator cap CAP is moved vertically (A) and rotated (B) by a predetermined angle. Accordingly, coolant may flow back into a reservoir tank 700 through the space between the vacuum valve 30 and a sealing member 40. To resolve the above problem, there is a need for a non-negative pressure radiator cap which prevents coolant from flowing back into a reservoir tank when a vacuum valve is opened.

The foregoing is intended merely to aid in the understanding of the background of the present invention, and is not intended to mean that the present invention falls within the purview of the related art that is already known to those skilled in the art.

SUMMARY

Therefore, the present invention provides a non-negative pressure radiator cap which is moved vertically when a vacuum valve provided therein is opened in a cooling system of a vehicle, thereby preventing coolant from flowing back into a reservoir tank.

In accordance with the present invention, the above and other objects may be accomplished by the provision of a non-negative pressure radiator cap which may include a pressure valve having a pressure member, disposed inside a body while having an aperture therein, the pressure member being pressed based on an increase in pressure of coolant to move coolant toward a reservoir tank, a vacuum valve having a head part and a neck part and configured to move vertically based on the pressure of the coolant to open or close the aperture, the neck part passing through the aperture from bottom to top, a sealing member disposed between the pressure valve and the vacuum valve and having an insertion aperture formed at a position that corresponds to the aperture of the pressure valve, a retainer inserted into the aperture in the pressure valve and the insertion aperture in the sealing member, and a guide configured to guide the vacuum valve to be moved vertically when the vacuum valve is opened or closed.

The guide may have a pipe shape that extends downward from the sealing member, and the guide may have an inner diameter equal to or greater than a diameter of the head part, and thus, the head part may be moved within the guide when the vacuum valve is opened or closed. The head part may have a recessed groove recessed inward from an outer peripheral surface thereof to reduce a frictional resistance when the vacuum valve moves vertically. The recessed groove may consist of a plurality of recessed grooves spaced at predetermined intervals along the outer peripheral surface of the head part. The head part may have a contact protrusion formed along an outer peripheral surface thereof and protruding upward from an upper surface thereof by a predetermined height to thus seal the aperture when the vacuum valve is closed.

A space portion, that forms a predetermined space along an outer peripheral surface of the neck part, may be disposed where the head part comes into contact with the neck part. A stopper may be disposed at an end of the neck part, and a movement distance of the vacuum valve may be restricted by the stopper. A distance between the neck part and the pressure valve may be set to be a predetermined distance or less. The stopper may be a disc having a hollow portion formed therein, and the neck part may have a latching groove recessed inward along an outer peripheral surface thereof at the end thereof to latch the hollow portion of the stopper to the latching groove.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Reference will now be made in detail to a non-negative pressure radiator cap according to the exemplary embodiments of the present invention, examples of which are illustrated in the accompanying drawings. Wherever possible, the same reference numbers will be used throughout the drawings to refer to the same or like parts.

Figure 4:
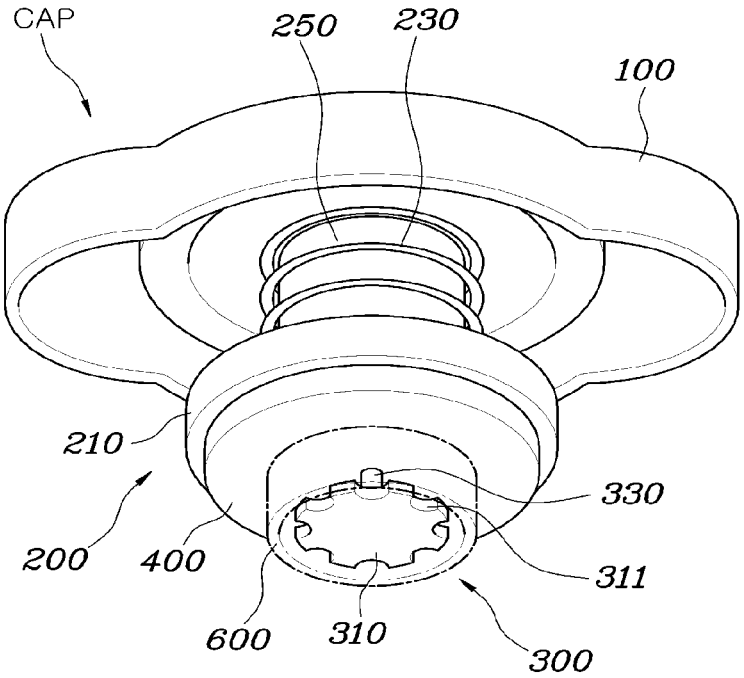
FIG. 4 is a view illustrating a non-negative pressure radiator cap according to an exemplary embodiment of the present invention.
Figure 5:
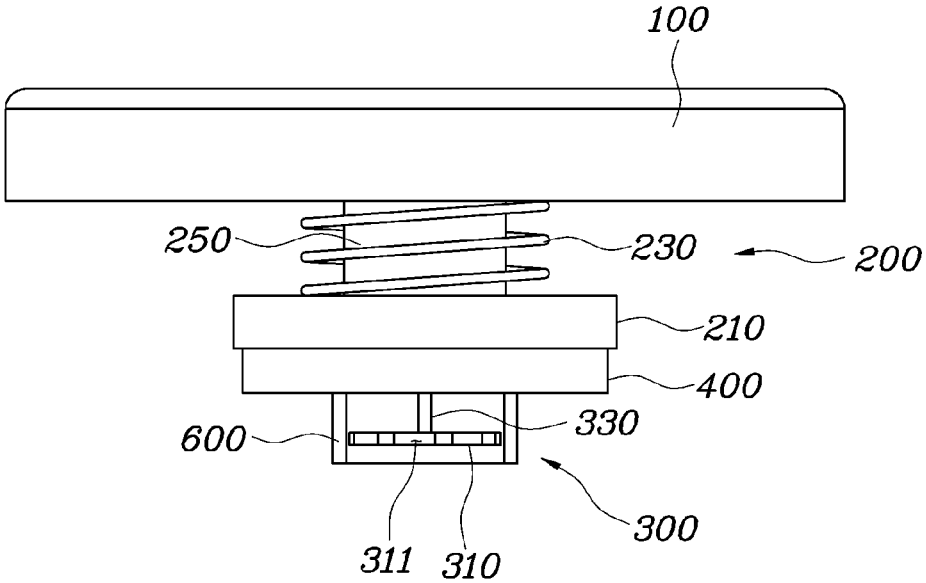
FIG. 5 is a front view of FIG. 4 according to an exemplary embodiment of the present invention.
Figure 6:
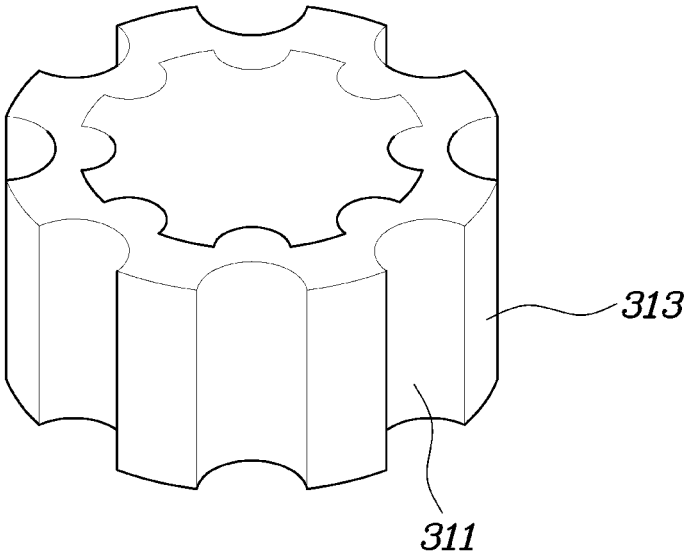
FIG. 6 is a detailed view illustrating a head part according to an exemplary embodiment of the present invention.
Figure 7:
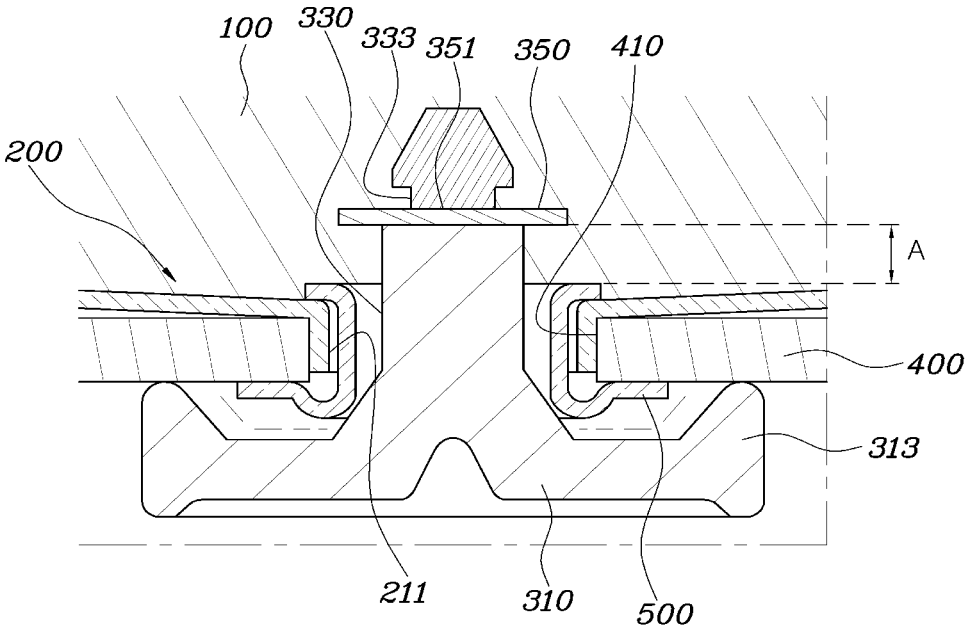
FIG. 7 is a view illustrating a vacuum valve according to a second exemplary embodiment of the present invention.
Figure 8:
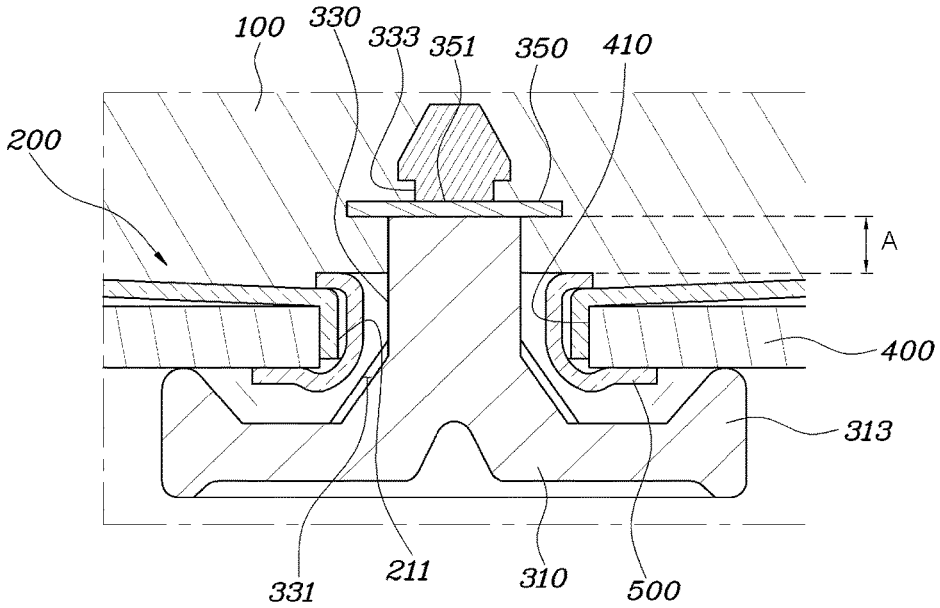
FIG. 8 is a view illustrating a vacuum valve according to a third exemplary embodiment of the present invention.
Figure 9:
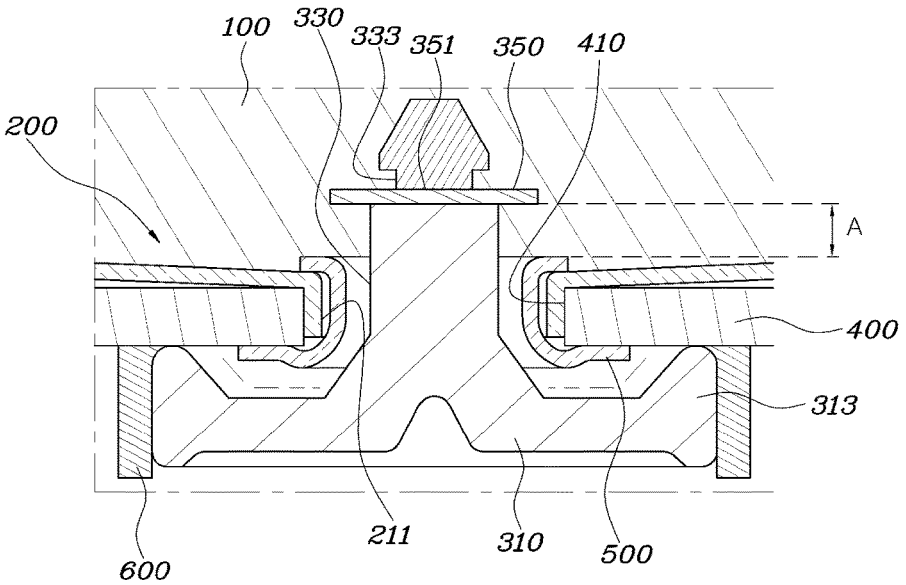
FIG. 9 is a view illustrating a vacuum valve according to a fourth exemplary embodiment of the present invention.
Figure 10:
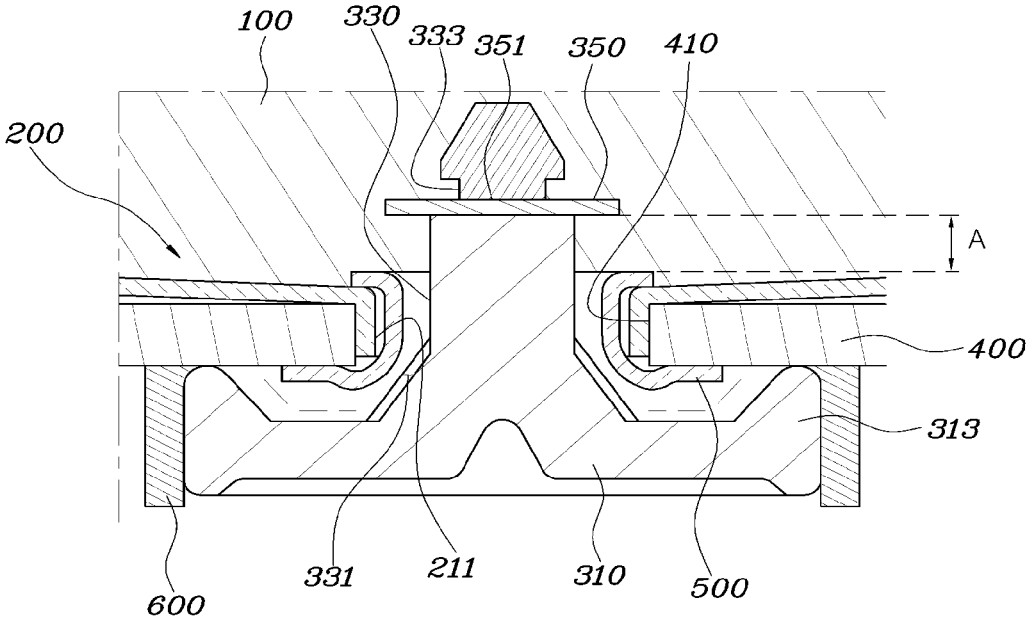
FIG. 10 is a view illustrating a vacuum valve according to a fifth exemplary embodiment of the present invention.
Figure 11:
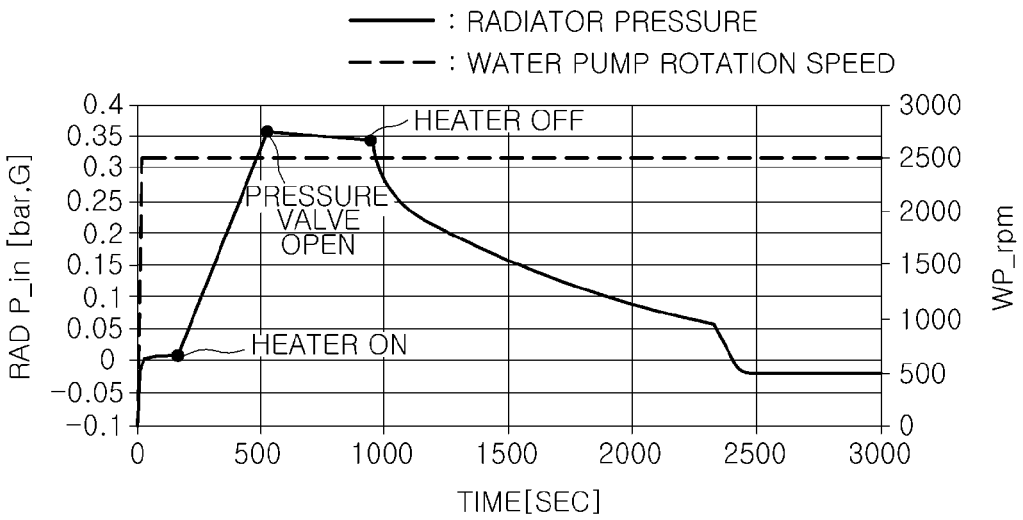
FIG. 11 is a graph illustrating the operation of FIG. 4 according to an exemplary embodiment of the present invention.

FIG. 4 is a view illustrating a non-negative pressure radiator cap according to an exemplary embodiment of the present invention. FIG. 5 is a front view of FIG. 4. FIG. 6 is a detailed view illustrating a head part 310. FIG. 7 is a view illustrating a vacuum valve 300 according to a second exemplary embodiment of the present invention. FIG. 8 is a view illustrating a vacuum valve 300 according to a third exemplary embodiment of the present invention. FIG. 9 is a view illustrating a vacuum valve 300 according to a fourth exemplary embodiment of the present invention. FIG. 10 is a view illustrating a vacuum valve 300 according to a fifth exemplary embodiment of the present invention. FIG. 11 is a graph illustrating the operation of FIG. 4.

The non-negative pressure radiator cap according to the present invention may be applied to a vehicle, and in particular, may be applied to an eco-friendly vehicle (a fuel cell vehicle) mounted with a fuel cell stack. Among the components of the non-negative pressure radiator cap according to the present invention, a vacuum valve 300 will be described with reference to the drawings. Accordingly, the shape or configuration of a pressure valve 200 are merely given by way of example, and are not limited to those illustrated and described in the specification. In addition, a detailed description of the pressure valve 200 will be omitted herein.

The non-negative pressure radiator cap according to the exemplary embodiment of the present invention may include a pressure valve 200 having a pressure member 210 disposed inside a body 100 and having an aperture 211 formed therein, the pressure member 210 being pressed based on an increase in pressure of coolant, to move coolant toward a reservoir tank 700, a vacuum valve 300 having a head part 310 and a neck part 330 and configured to move vertically based on the pressure of coolant to open or close the aperture 211 of the pressure valve 200, the neck part 330 passing through the aperture 211 from bottom to top, a sealing member 400 disposed between the pressure valve 200 and the vacuum valve 300 and having an insertion aperture 410 formed at a position that corresponds to the aperture 211 of the pressure valve 200, a retainer 500 inserted into the aperture 211 in the pressure valve 200 and the insertion aperture 410 in the sealing member 400, and a guide 600 configured to guide the vacuum valve 300 to move vertically when the vacuum valve 300 is opened or closed.

As illustrated in FIGS. 4 and 5, the pressure valve 200 may include a shaft 250 that extends downward from the body 100, a pressure member 210 disposed at the lower end of the shaft 250 and having an aperture 211 formed therein, and an elastic member 230 wound around the outer peripheral surface of the shaft 250. Accordingly, the pressure member 210 may be pressed in proportion to an increase in pressure of coolant to press (e.g., push, exert pressure onto, etc.) the elastic member 230, and thus may be configured to move upward to open the pressure valve 200. Accordingly, the coolant in the radiator may move to the reservoir tank 700.

The vacuum valve 300 may include the head part 310 and the neck part 330, and may have an inverse "T" shape as illustrated in the drawings. The neck part 330 may be configured to pass through the aperture 211 from bottom to top. Similar to the pressure valve 200, the vacuum valve 300 may be configured to move vertically based on the pressure of coolant to open or close the aperture 211 of the pressure valve 200, thereby allowing coolant to move to the reservoir tank 700 or blocking the movement of coolant to the reservoir tank 700.

In particular, the vacuum valve 300 may include the guide 600 configured to guide (e.g., direct) the vacuum valve 300 to vertically move the vacuum valve 300 when the vacuum valve 300 is opened or closed. The guide 600 may have a pipe shape that extends downward from the sealing member 400. In addition, the guide 600 may have an inner diameter equal to or greater than the diameter of the head part 310. Thus, when the vacuum valve 300 is opened or closed, the head part 310 may be moved within the guide 600 and may be directed by the guide 600. Accordingly, since the vacuum valve 300 may be moved within the guide 600, the vacuum valve 300 may be configured to move without rotation. Therefore, it may be possible to prevent coolant from flowing back into the reservoir tank 700 when the vacuum valve 300 is opened.

The head part 310 may include a recessed groove 311 recessed (e.g., depressed) inward from the outer peripheral surface thereof. The recessed groove 311 may include a plurality of recessed grooves spaced at predetermined intervals along the outer peripheral surface of the head part 310. When the vacuum valve 300 moves vertically, the frictional resistance between the vacuum valve 300 and the guide 600 may be reduced by the recessed groove 311.

As illustrated in FIG. 6, the head part 310 may include a contact protrusion 313 formed along the outer peripheral surface thereof and that protrudes upward from the upper surface of the head part by a predetermined height. Accordingly, it may be possible to increase the airtightness (e.g., the seal) of the aperture 211 when the vacuum valve 300 is closed. The contact protrusion 313 may be formed along the outermost peripheral surface of the head part 310 formed with the recessed groove 311 while having a predetermined height, or may be formed at a position displaced inward from the outermost peripheral surface of the head part 310 while having a pipe shape. The contact protrusion 313 may have any shape that is capable of increasing the airtightness of the vacuum valve 300.

FIG. 7 is a view illustrating a vacuum valve 300 according to a second exemplary embodiment of the present invention. As illustrated in FIG. 7, a neck part 330 of the vacuum valve 300 may have an increased diameter compared to existing neck parts. Accordingly, the spacing between the retainer 500 and the neck part 330 may be reduced, as a result of which the vacuum valve 300 may be supported when the vacuum valve 300 moves vertically. Consequently, it may be possible to prevent a head part 310 from rotating and to block movement of coolant to the reservoir tank 700.

FIG. 8 is a view illustrating a vacuum valve 300 according to a third exemplary embodiment of the present invention. As illustrated in FIG. 8, at a location where a head part 310 comes into contact with (e.g., abuts) a neck part 330 in the vacuum valve 300, a space portion 331, which forms a predetermined space along the outer peripheral surface of the neck part 330, may be provided. The shape of the retainer 500 may vary based on the shape of the space portion 331 since the neck part 330 of the vacuum valve 300 is supported by the distance between the vacuum valve 300 and the retainer 500 when the vacuum valve 300 is opened or closed. The spacing between the neck part 330 and the retainer 500 may be set to be within a predetermined distance to allow regular flow of the coolant, and the head part 310 may be configured to rotate when the vacuum valve 300 moves vertically to thus block the movement of coolant to the reservoir tank 700.

FIG. 9 is a view illustrating a vacuum valve 300 according to a fourth exemplary embodiment of the present invention. FIG. 10 is a view illustrating a vacuum valve 300 according to a fifth exemplary embodiment of the present invention. As illustrated in FIGS. 9 and 10, by applying the guide 600 to the exterior of the head part 310 of the vacuum valve 300 according to the exemplary embodiments of FIGS. 7 and 8, the vacuum valve 300 according to the present exemplary embodiments may obtain a more robust structure, and thus the vertical movement of the vacuum valve 300 may be guided more robustly.

In the exemplary embodiments of the present invention illustrated in FIGS. 7 to 10, the distance between the neck part 330 and the retainer 500 may be reduced by increasing the diameter of the neck part 330, thereby enabling the neck part 330 to be supported when the vacuum valve 300 moves vertically. Consequently, the vertical movement of the vacuum valve 300 may be guided. In particular, the neck part 330 may have a diameter of about 3.7 mm.

In addition, a stopper 350 may be disposed at the end of the neck part 330 of the vacuum valve 300. The stopper 350 may specifically be configured to restrict the movement distance (A; stroke) of the vacuum valve 300. In particular, the distance between the neck part 330 and the pressure valve 200 may be set to be a predetermined distance or less. For example, the movement distance may be about 1.0 mm. In addition, the stopper 350 may be formed as a disc having a hollow portion 351 formed therein, and the neck part 330 may have a latching groove 333 recessed inward along the outer peripheral surface thereof at the end thereof, and thus the hollow portion 351 of the stopper 350 may be latched to the latching groove 333.

Accordingly, the non-negative pressure radiator cap may further include the guide 600 disposed extraneous to the vacuum valve 300 and may be configured to guide or direct the vertical movement thereof. In particular, the head part 310 may be formed with the recessed groove 311 to reduce the friction between the guide 600 and the valve. Thus, the vacuum valve 300 may come into surface contact with (e.g., abut) the sealing member 400 when coolant is pressurized, to increase the pressurization thereof. In addition, the vacuum valve 300 may be directed by the guide 600 to be movable downward when a negative pressure is formed, and thus a normal pressure may be rapidly recovered.

Figure 1:
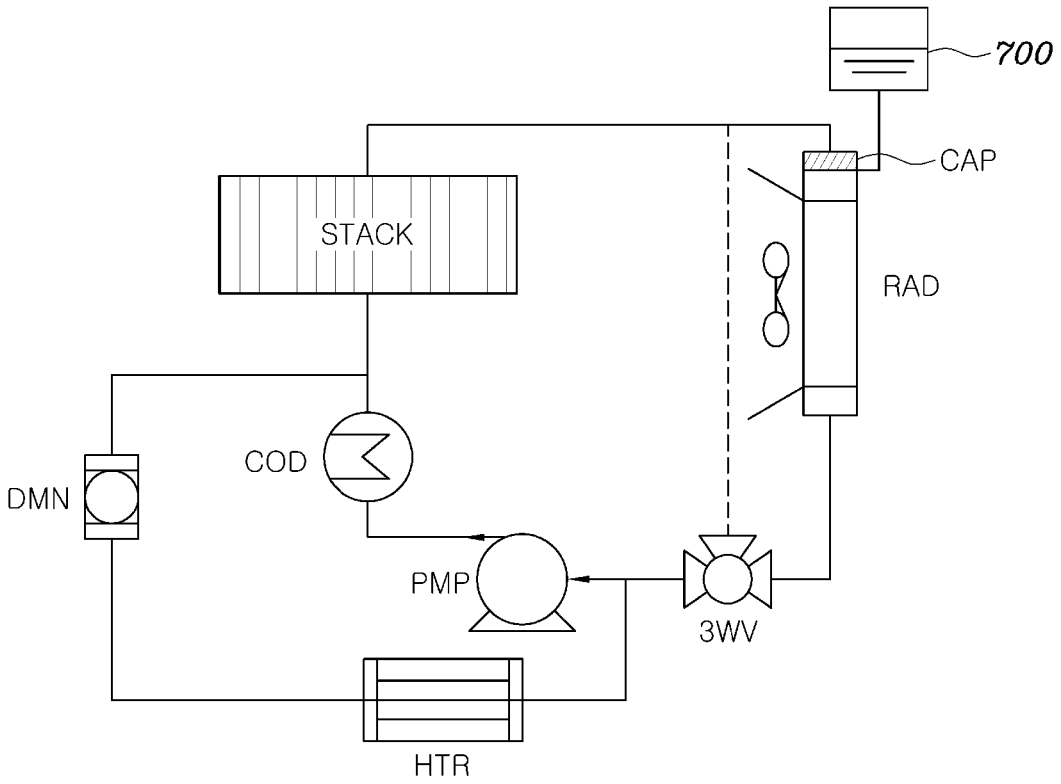
FIG. 1 Related Art
FIG. 1 is a diagram illustrating a cooling system of a typical fuel cell vehicle according to the related art.
Figure 2:
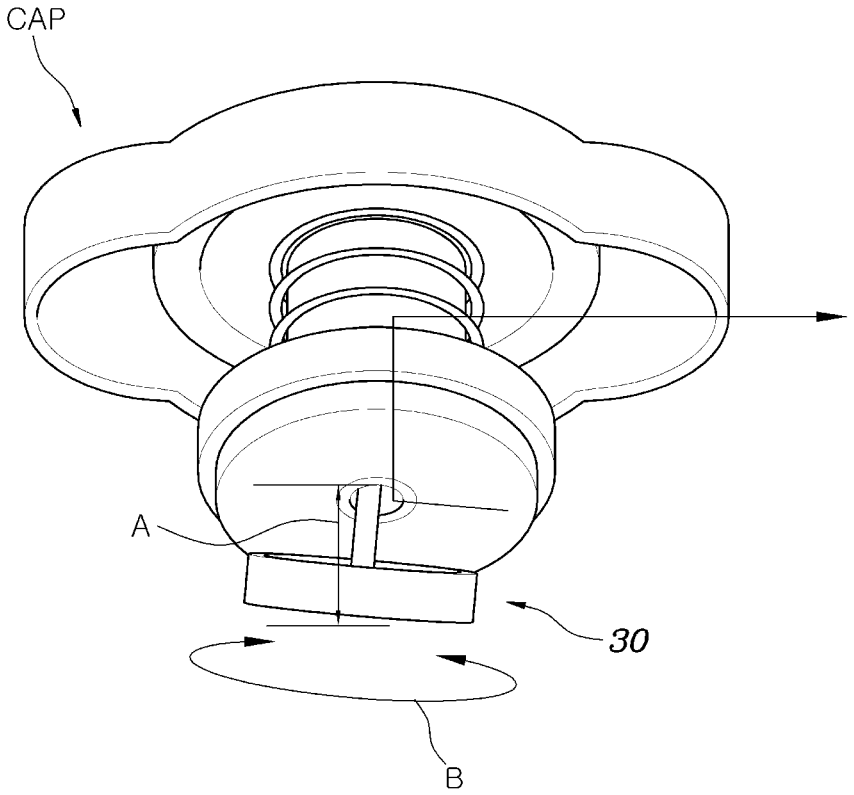
FIG. 2 Related Art
FIG. 2 is a view illustrating a conventional radiator cap according to the related art.
Figure 3:
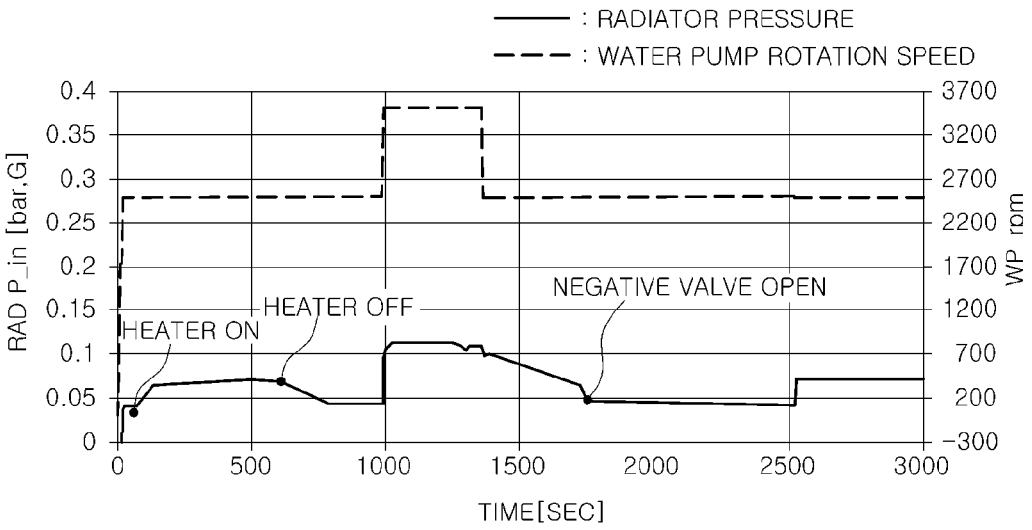
FIG. 3 Related Art
FIG. 3 is a graph illustrating the operation of FIG. 2 according to the related art.

In particular, the diameter of the neck part 330 of the vacuum valve 300 may be increased to about 3.7 mm, and the movement distance may be decreased to about 1 mm. Accordingly, it may be possible to prevent coolant from flowing back into the vacuum valve 300 when the coolant is pressurized, and to increase the temperature and pressure of coolant. When the conventional radiator cap is applied, the temperature and pressure of coolant are not increased at all, as illustrated in FIG. 3. However, when the radiator cap of the present invention is applied, the pressure of coolant begins to increase once the heater is turned on to allow the opening of the radiator cap, and the temperature and pressure of coolant may be rapidly decreased once the heater is turned off, as illustrated in FIG. 11. Particularly, the pressure valve 200 may be tuned in which the pressure rate of the pressure valve 200 may be varied in the initial stage of temperature increase, by additionally coupling elements such as a nut and a bushing to the elastic member 230.

Therefore, the non-negative pressure radiator cap according to the present invention may eliminate cavitation and flow noise due to negative pressure formed at the front end of the pump in the cooling system of the vehicle. In addition, it may be possible to improve cooling performance and prevent coolant from vaporizing by improving the seal of the non-negative pressure radiator cap.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A non-negative pressure radiator cap, comprising:

a pressure valve including a pressure member, disposed inside a body of the pressure valve while having an aperture formed therein, the pressure member being pressed based on an increase in pressure of coolant to move the coolant toward a reservoir tank;

a vacuum valve including a head part and a neck part and configured to move vertically based on the pressure of the coolant to open or close the aperture, the neck part passing through the aperture from bottom to top;

a sealing member disposed between the pressure valve and the vacuum valve and having an insertion aperture formed at a position that corresponds to the aperture of the pressure valve;

a retainer inserted into the aperture in the pressure valve and the insertion aperture in the sealing member; and a guide configured to guide the vacuum valve to move vertically when the vacuum valve is opened or closed, wherein the head part includes a recessed groove recessed inward from an outer peripheral surface thereof to reduce a frictional resistance when the vacuum valve moves vertically, and wherein the guide has an inner diameter substantially equal to a diameter of the head part so as to permit movement of the head part within the guide including frictional engagement between the head part and the guide so as to prevent the vacuum valve from being rotated when the vacuum valve is opened or closed.

2. The non-negative pressure radiator cap according to claim 1, wherein the guide has a pipe shape that extends downward from the sealing member.

3. The non-negative pressure radiator cap according to claim 1, wherein the recessed groove includes a plurality of recessed grooves spaced at predetermined intervals along the outer peripheral surface of the head part.

4. The non-negative pressure radiator cap according to claim 1, wherein the head part includes a contact protrusion formed along an outer peripheral surface thereof and that protrudes upward from an upper surface thereof by a predetermined height to seal the aperture when the vacuum valve is closed.

5. The non-negative pressure radiator cap according to claim 1, wherein a space portion, that forms a predetermined space along an outer peripheral surface of the neck part, is disposed at a position where the head part comes into contact with the neck part.

6. The non-negative pressure radiator cap according to claim 1, wherein a stopper is disposed at an end of the neck part, and a movement distance of the vacuum valve is restricted by the stopper.

7. The non-negative pressure radiator cap according to claim 6, wherein a distance between the neck part and the pressure valve is set to be a predetermined distance or less.

8. The non-negative pressure radiator cap according to claim 6, wherein the stopper is formed as a disc having a hollow portion formed therein, and the neck part includes a latching groove recessed inward along an outer peripheral surface at the end thereof and the hollow portion of the stopper is latched to the latching groove.

* * * * *